US008581183B2

(12) United States Patent
Räther

(10) Patent No.: US 8,581,183 B2
(45) Date of Patent: Nov. 12, 2013

(54) CALIBRATION FUNCTION FOR TIME-OF-FLIGHT MASS SPECTROMETERS WITH EXTREME MASS ACCURACY

(75) Inventor: Oliver Räther, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 80 days.

(21) Appl. No.: 13/232,204

(22) Filed: Sep. 14, 2011

(65) Prior Publication Data

US 2012/0074303 A1 Mar. 29, 2012

(30) Foreign Application Priority Data

Sep. 28, 2010 (DE) ..... 10 2010 046 731

(51) Int. Cl.
*H01J 49/40* (2006.01)

(52) U.S. Cl.
USPC ..... 250/287; 250/282; 702/28

(58) Field of Classification Search
USPC ..... 250/281, 282, 286, 287; 702/22, 23, 27, 702/28, 29
See application file for complete search history.

(56) References Cited

U.S. PATENT DOCUMENTS

| | | | | |
|---|---|---|---|---|
| 5,654,545 | A | 8/1997 | Holle | |
| 5,969,348 | A | 10/1999 | Franzen | |
| 6,188,064 | B1 | 2/2001 | Koster | |
| 2004/0159783 | A1* | 8/2004 | Gavin et al. | 250/282 |
| 2004/0248318 | A1* | 12/2004 | Weinberger et al. | 436/173 |
| 2006/0071160 | A1 | 4/2006 | Haase | |
| 2008/0308724 | A1 | 12/2008 | Brekenfeld | |
| 2010/0096543 | A1* | 4/2010 | Kenny et al. | 250/282 |
| 2011/0215238 | A1 | 9/2011 | Kajihara | |

FOREIGN PATENT DOCUMENTS

WO 2010052756 A 5/2010

* cited by examiner

*Primary Examiner* — Nicole Ippolito
(74) *Attorney, Agent, or Firm* — Robic, LLP

(57) ABSTRACT

A calibration function for time-of-flight mass spectrometers that converts ion times of flight into mass to charge ratios, takes into account not only the time of flight of a specific ionic species, but also the ion signal intensity of that ionic species. Use of the conversion function reduces nonsystematic deviations of the calculated mass values from the true mass values previously experienced in time of flight mass spectrometers.

9 Claims, 3 Drawing Sheets

CALIBRATION FUNCTION FOR TIME-OF-FLIGHT MASS SPECTROMETERS WITH EXTREME MASS ACCURACY

BACKGROUND

The invention relates to methods for converting time-of-flight values of ion signals into mass values in time-of-flight mass spectrometers with extreme mass accuracy. Modern time-of-flight mass spectrometers can measure the mass-to-charge ratios m/z of the ions with a precision which would have been unthinkable only a few years ago, and this not only in individual, spectacular measurements, but practically as daily routine. The precision, i.e. the reciprocal spread of measurements repeated many times, achieved today with highly developed time-of-flight mass spectrometers, using internal mass calibration, is now better than one ppm (part per million), often 100 ppb (parts per billion) or even better. According to current expert opinion, it should then also be simple for such an instrument to bring the accuracy of measuring the mass-to-charge ratios m/z, i.e. the deviation from the true mass value, to the same order of magnitude by a calibration and the use of mass reference substances which provide ion signals in the same spectrum ("internal references"). It is apparent, however, that calibration functions which should provide a very accurate mass determination by a mathematical representation, i.e. by a functional relationship between mass and time of flight, constantly pose new challenges as the demands placed on the measurement accuracy increase.

In mass ranges between 1,000 and 6,000 atomic mass units, time-of-flight mass spectrometers with ionization by matrix-assisted laser desorption (MALDI-TOF) are currently advancing toward mass resolutions of better than R=m/Δm=50,000, where Δm is the full width at half-maximum of the mass signal at mass m. These values are surprising; they mean that, in the higher mass range, the MALDI time-of-flight mass spectrometers surpass all other types of mass spectrometer, even ion cyclotron resonance mass spectrometers (ICR-MS) and electrostatic Kingdon ion traps (for example, the Orbitrap™), whose fundamentally high mass resolution decreases as 1/m or $$\frac{1}{\sqrt{m}}$$

toward higher masses. The successes of time-of-flight mass spectrometers are based on improvements to the acceleration electronics and the detector, an increase in the sampling rate in the transient recorders and, in particular, better mastery of the MALDI processes by using improved laser technology, as described, for example, in DE 10 2004 044 196 A1 (A. Haase et al., corresponding to GB 2 421 352 B and US-2006-0071160 B1). A major contribution to the continuous improvement of this technology has been made by the long-known time-delayed acceleration, as described by U.S. Pat. No. 5,654,545 A (Holle et al., corresponding to GB 2 305 539 B), for example, and by the shaping of a temporally changing acceleration as described in DE 196 38 577 C1 (J. Franzen, corresponding to GB 2 317 495 B and U.S. Pat. No. 5,969,348 B1), which causes the region with maximum mass resolution to extend evenly over a wide mass range rather than being located at one point of the mass spectrum.

Time-of-flight mass spectrometers with orthogonal ion injection (OTOF), which are usually operated with electrospray ion sources (ESI), but are now increasingly being operated with other types of ion sources, are also advancing into these regions of mass resolution by virtue of similar technical improvements. Here the acceleration of the ions of a primary ion beam into the flight path of the mass spectrometer, at right angles to the previous direction, is carried out instantaneously by suddenly switching on the accelerating voltage.

If ions are accelerated to a kinetic energy E in an ideal way, i.e. simultaneously by switching on the acceleration in MALDI-TOF or OTOF mass spectrometers in an infinitesimally short time, it is possible to determine the relationship between their time of flight $\Delta t = t - t_0$ over a distance L and their mass m from the basic equations:

$$E = (m/2) \times v^2 = (m/2) \times L^2/(t - t_0)^2; \quad [1]$$

$$m = 2E \times (t - t_0)^2/L^2; \quad [2]$$

$$t = t_0 + L \times \sqrt{\frac{m}{2E}}. \quad [3]$$

But for various reasons, these equations only constitute approximations.

For instance, it has long been known that, in MALDI mass spectrometers, the ions of all masses receive a common velocity distribution with a common average initial velocity $v_0$, in the adiabatically expanding plasma of the matrix-assisted laser desorption (MALDI). The kinetic energy E after the electric post-acceleration of the ions thus comprises two components: the energy $E_U$ caused by the electric acceleration, and the initial energy $E_0 = (m/2) \times v_0^2$, which originates from the MALDI process:

$$E = E_U + E_0 = E_U + (m/2) \times v_0^2. \quad [4]$$

If one introduces this additional condition into the above Equations [2] and [3] and then makes several approximations which are based on the fact that the initial energy $E_0$ is very small compared to the energy $E_U$ from the electric acceleration, one obtains a very good approximate equation for the time of flight as a function of the mass:

$$t \approx c_0(\sqrt{m})^0 + c_1(\sqrt{m})^1 + c_3(\sqrt{m})^3, \quad [5]$$

and also a very good approximate equation for the mass as a function of the time of flight:

$$m \approx k_2(t - t_0)^2 + k_4(t - t_0)^4, \quad [6]$$

which can be used to a large extent for both MALDI time-of-flight mass spectrometers and time-of-flight mass spectrometers with orthogonal injection (OTOF-MS).

The coefficients $c_0$ to $c_3$ and $t_0$, $k_2$ and $k_4$ are determined by mathematical fittings from the ion signals of a mass spectrum of a calibration substance with accurately known masses. Such fitting procedures are known to those skilled in the art. For an OTOF-MS, where the ions have no initial velocity, the coefficient $c_3$ can also be assumed to be zero. The physical meaning and origin of the coefficients are immaterial for the application, but they are given below for the sake of completeness:

$$c_0 = t_0; \quad [7]$$

$$c_1 \approx \frac{L}{\sqrt{2E_U}};$$

-continued $$c_3 \approx \frac{L \cdot v_0^2}{\sqrt{32(\sqrt{E_U})^3}};$$

$$k_2 = 2E_U / L^2 + m_0 v_0^2 / L^2;$$

$$k_4 = 2E_U v_0^2 / L^4.$$

It is, however, impossible to instantaneously, i.e. in no time, switch on an accelerating field by applying a voltage to a diaphragm which is arranged in a stack of other diaphragms and which has a considerable capacitance with respect to the others. If the diaphragm has a low-resistance connection to a power supply then, after the capacitance has charged up, which takes a finite time, the inductance of the supply lead means there is always a periodic overshooting, which is only slowly damped by the ever-present resistances of the materials. This overshooting has very damaging impacts on the acceleration of the ions and hence on the calibration function. Where possible, the overshooting is therefore damped by additional resistors in the supply lead to such an extent that the limiting aperiodic case of the switching occurs, which results in a constant voltage in the shortest time, but not without a transition curve. In fact, a slightly larger resistor is used to enable better reproducibility of manufacture, which means that the approach remains somewhat removed from this actually ideal aperiodic limiting case, and therefore an approach to the final strength of the acceleration field takes the form of a creeping exponential curve. This "dynamic acceleration" changes the calibration function for both OTOF-MS as well as for MALDI-TOF-MS.

In DE 10 2007 027 143 B3 (A. Brekenfeld) a method is now disclosed for taking account of this dynamic acceleration in the calibration function by assuming a reduced mass $m-m_0$. The formal assumption of a reduced mass $m-m_0$ is based simply on the observation that the systematic mass deviations become relatively larger toward smaller masses. Since the light ions leave the acceleration region before the full accelerating voltage is reached, they do not possess the full acceleration energy $E_U$. Mathematically, it is scarcely possible to take account of the energy defect, while assuming an analogous mass defect leads to simple solutions for the calibration function.

If one introduces the reduced mass $m-m_0$ into Equation [5] and expands it with respect to $\sqrt{m}$, one obtains a further term $c_{-1}\times(\sqrt{m})^{-1}$, so that the series expansion is now:

$$t \approx c_{-1}\times(\sqrt{m})^{-1}+c_0\times(\sqrt{m})^0+c_1\times(\sqrt{m})^1+c_3\times(\sqrt{m})^3 \quad [8]$$

The reduction mass $m_0$ is obtained from the coefficients of $2c_{-1}/c_1$. Introducing a reduction mass $m_0$ is therefore equivalent to introducing the term with $$\frac{1}{\sqrt{m}}.$$

Similarly, introducing the reduced mass $m-m_0$ into Equation [6] leads additionally to a constant term:

$$m \approx k_0+k_2(t-t_0)^2+k_4(t-t_0)^4, \text{ where } k_0=m_0. \quad [9]$$

The two Equations [8] and [9] have only four coefficients each. Further terms can, of course, be added to both equations, for example with the coefficients $C_{-2}$, $c_2$, $c_4$, $k_1$ and $k_3$, to improve the accuracy of fitting. For best results, the additional terms should be selected experimentally. The additional terms do not have a physical interpretation.

The calibration functions on the basis of Equation [8] or [9] provide good results. With only one added term, i.e. with 5 coefficients each, the systematic residual errors over an extremely wide mass range of between 120 up to over 3,000 atomic mass units can be reduced to one to two parts per million of the mass. With this calibration function it is particularly possible to successfully extrapolate to large masses far beyond the calibrated range.

In time-of-flight mass spectrometers, the ion currents of the ions reaching the detector are amplified, digitized with a constant digitizing rate and stored as digital values in the order they were measured. Normal practice is to acquire several hundred to several thousand individual spectra in succession from one sample and to add them together, digital value by digital value, to form a sum spectrum. The original sum mass spectrum therefore consists of a long series of digital measured values where the associated times of flight t of the ion currents do not appear explicitly but merely form the indices of the measurement series. The measurement series is analyzed for the occurrence of prominent current signals; these represent the ion signals. A large number of algorithms and software programs, which are commonly called "peak recognition programs", are available to identify these ion signals. The time of flight t for an ion peak, whose measured values regularly extend over several indices, is interpolated from the indices of the measured values. By using good peak recognition procedures, it is possible to obtain precisions for the times of flight which are much better than the time intervals of the digitizing rate.

The precision of the time-of-flight determination depends on the digitizing rate. The transient recorders of modern commercial time-of-flight mass spectrometers usually use a digitizing rate of two to four gigasamples per second; however, it is to be expected that, in the future, scanning rates of eight or more gigasamples per second will be available and will be used. It is therefore to be expected that with good interpolations of the peak recognition procedures, it will be possible to achieve precisions of approximately a hundredth of a nanosecond for the time-of-flight determination. A very precise peak recognition procedure, which is based on the simultaneous consideration of all ion signals of a group of isotopes, is described in DE 198 03 309 C1 (C. Koester, corresponding to U.S. Pat. No. 6,188,064 B1 and GB 2 333 893 B). Since a mass range of up to some 6,000 atomic mass units is scanned in approximately 100 microseconds, mass accuracies much better than one part per million are to be expected in principle. As has already been mentioned above, the precision of highly developed time-of-flight mass spectrometers is currently around 100 ppb, i.e. one ten millionth of the mass-to-charge ratio m/z.

As the development of time-of-flight mass spectrometers progresses toward ever increasing mass accuracies, one encounters phenomena which cannot yet be explained. Although highly developed time-of-flight mass spectrometers display precisions which are around ±100 ppb, the true mass values show erratic deviations of several hundred ppb up to a few ppm despite being referenced to one or more internal reference masses. These deviations differ from instrument to instrument and even from substance to substance in the same instrument. These individual, apparently nonsystematic mass deviations for ions of individual substances cannot be removed by a calibration with one of the calibration functions mentioned above despite the high precision of the measurements.

SUMMARY

In accordance with the principles of the invention, a conversion for time-of-flight mass spectrometers incorporates not only the measured value t for the time of flight of an ionic species i, but also the signal intensity $s_i$ (signal height or signal area), i.e. a value which essentially characterizes the number of ions which fly together through the mass spectrometer in each case. In particular, it has been found that the so-far unexplained mass deviations between measured mass values and the true masses for individual ionic species display a correlation with the signal intensities of these ionic species which was completely unexpected for time-of-flight mass spectrometers.

The inventive calibration function takes into account the fact that in mass spectrometers designed to measure the masses of the ions with an extreme mass accuracy of one part per million or even far better, effects occur which resemble a "traffic jam" of the charged particles. This traffic jam depends on the number of ions of an ionic species flying together through the instrument. To visualize this phenomenon, one could say that it is as if the ions have to fly through a funnel, which can easily become congested due to the large number of ions arriving simultaneously, and thus lead to the traffic block. The calibration function therefore contains a traffic jam correction.

DETAILED DESCRIPTION

Highly developed time-of-flight mass spectrometers display a precision of around ±100 ppb, even over days using the same calibration curve, for repeated measurements of substance ions masses. However, the mass values calculated by best-fit calibration functions exhibit apparently nonsystematic deviations from the true mass values of several hundred ppb, or even a few ppm, despite being referenced to one or more internal reference masses; these deviations can differ from instrument to instrument and even from substance to substance in the same instrument. Despite the high precision of the measurements, it was not possible to remove these individual mass deviations for ions of individual substances by a calibration of the type mentioned above, including the use of reference masses of one or even several reference substances.

The problem of the uncorrectable mass deviations led to investigations aimed at finding possible causes for these apparently nonsystematic mass deviations. The hypothesis that the mass deviations depended on the structure of the substances was discounted relatively quickly because identical substances showed different mass deviations, even in terms of direction, in different mixtures or on different instruments.

In time-of-flight mass spectrometers, in which the ions take less than 100 milliseconds to transit, and the ions of different masses continuously move away from each other, it is hardly possible for the ions to influence each other. The only place where phenomena such as so-called "peak coalescence", i.e. the mass signals of ions with slightly different mass moving closer together, can occur is at the point of reversal of the reflector, as has been proven in multi-path time-of-flight mass spectrometers with many points of reversal. A "peak coalescence" can be excluded with certainty in the present case, however.

Figure 3:
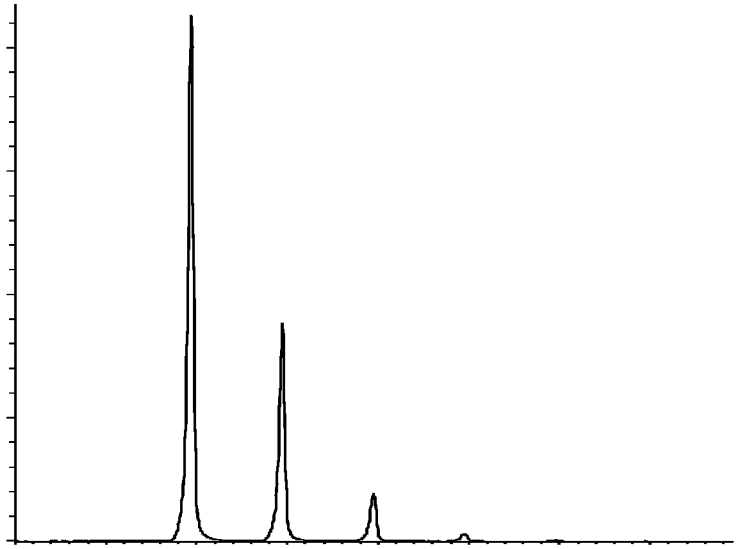
FIG. 3 depicts the mass spectrum of the isotope group of a phosphazene.
Figure 4:
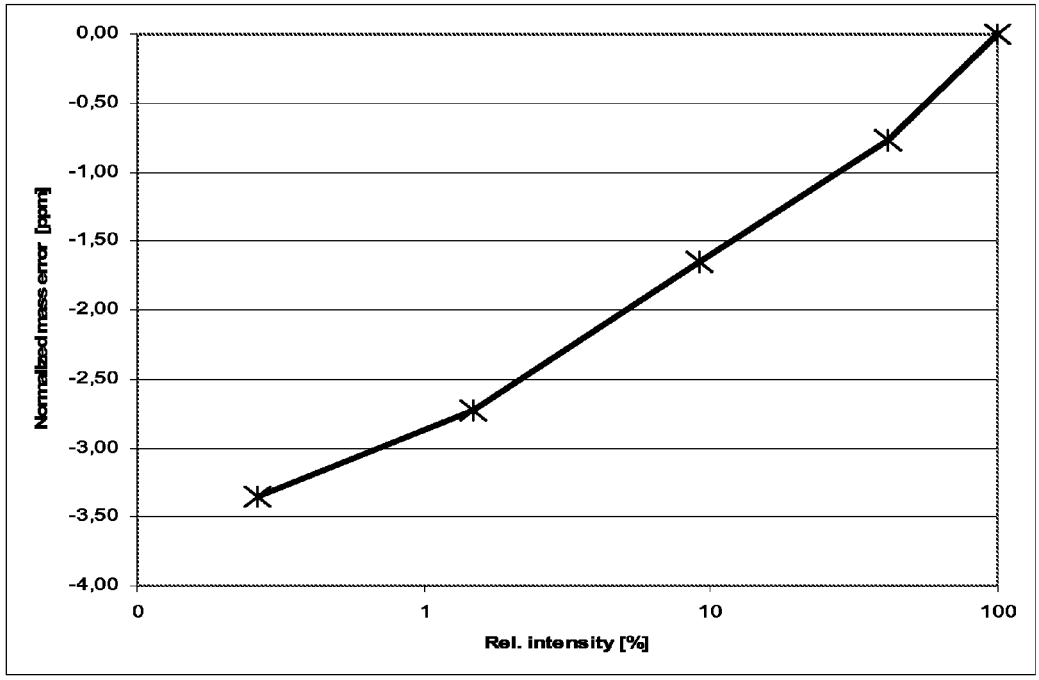
FIG. 4 shows the mass deviations for the isotopes of the phosphazene in ppm as a function of the logarithm of the signal intensity.

Although it actually seemed unthinkable that, in a time-of-flight mass spectrometer, the mass determination could depend on the intensity of the ion signals, a measurement method was developed for the investigations which allowed very tiny mass deviations to be measured for ions with practically the same masses and the same number of charges but whose intensities ranged over several orders of magnitude. The mass deviations of isotope signals of a substance whose signals could be measured over several orders of magnitude of their signal height were chosen as the basis. Surprisingly it turned out that the isotope signals exhibited a trend showing the mass deviations depending on their signal heights. FIGS. 3 and 4 show the isotope spectrum and the trend of the mass deviations for singly charged ions of a phosphazene. The intensity differences correlate unequivocally over around 2.5 orders of magnitude with the mass deviations, which vary here by more than 3 ppm.

Figure 5:
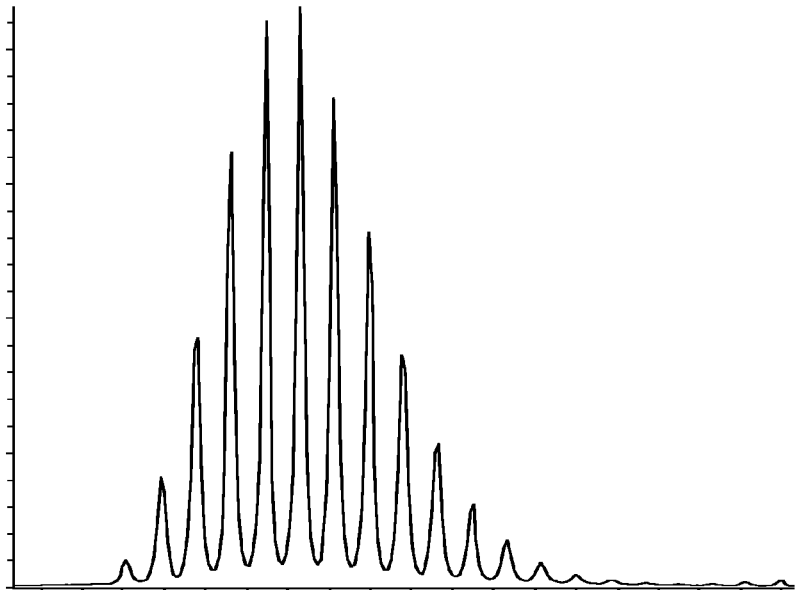
FIG. 5 represents the mass spectrum of the isotope group of ubiquitin ions with twelve charges.

Such a mass deviation trend could, of course, also simply be caused by the sequence of the mass signals, if the ions of previous mass signals somehow influence the ions of the subsequent mass signals. In order to exclude this trend with the sequence, ubiquitin ions with twelve charges were investigated; the isotope signals of these ions have an intensity which initially increases before decreasing again, as shown in FIG. 5. The mass deviations shown in FIG. 6 exhibit two branches, making it clear that a quantitatively dominant correlation with the intensity of the signals exists. But a sequence effect, which is caused by incompletely resolved mass signals (see FIG. 5), is superimposed on this correlation. In the ascending sequence, the mass signals are shifted toward heavier masses because they overlap with the tails of the adjacent higher mass signals, on the descending side signals are shifted toward lighter masses. This results in a non-complete congruence of the two branches. In conclusion, the mass deviations depend mainly on the intensity of the mass signals, however this effect may be superimposed by other effects.

The invention therefore uses a conversion for time-of-flight mass spectrometers which incorporates not only the measurement value t for the time of flight of an ionic species i, but also the signal intensity $s_i$, a parameter which represents the height or area of the ion signal and thus characterizes the number of ions of this ion species which fly together through the mass spectrometer in each case. Since one cannot exclude the possibility that the number $z_i$ of charges of an ion also plays a role, the parameter $z_i$ is also taken into account, although it can also be dropped from the equation. The conversion function thus takes the form:

$$(m/z)_i = f((t-t_0) - g(t_i - t_0, s_i, z_i)). \quad [10]$$

In this representation, the time of flight $t_i - t_0$ is first corrected by a contribution $g(t_i - t_0, s_i z_i)$ which depends on the intensity, the time of flight and the charge, before being subjected to a conventional calibration function, such as the one derived above [9]. There are also other representations with the same effect, for example:

$$(m/z)_i' = f(t_i - t_0) - g'(t_i - t_0, s_i, z_i), \quad [11]$$

where the masses (m/z), are first calculated in the usual way by means of a known calibration function and only then corrected by the term g'.

Since the traffic jam for the ions means that the measured times of flight $(t_i - t_0)$, and the masses m/z derived therefrom, are too high, the corrections g and g' in the Equations [10] and [11] have a negative sign. It is assumed in both Equations [10] and [11] that the correction depends not only on the signal height (or signal area) $s_i$ but also on the time of flight $t_i$ and the number of ionic charges $z_i$. This is not imperative, however.

The precise form of the correction function g can only be stated approximately here. If the correction function g for the time of flight $(t_i - t_0)$ depends neither on the time of flight nor on the number $z_i$, of ionic charges, for example, it is possible to deduce from FIGS. 4 and 6 that it has at least approximately the form:

$$g = p(\log s_i)^q;\ q \geq 1 \quad [12]$$

where $s_i$ was measured as the height of the signals, and p and q are two fitting parameters which must be determined experimentally by known fitting procedures. When using q=1, the representations of the deviation curves in FIGS. 4 and 6 would each have to be straight lines. This applies quite well in a first approximation. With q>1 the correction is better fitted to slightly bent curves, as is indicated in FIGS. 4 and 6.

Figure 6:
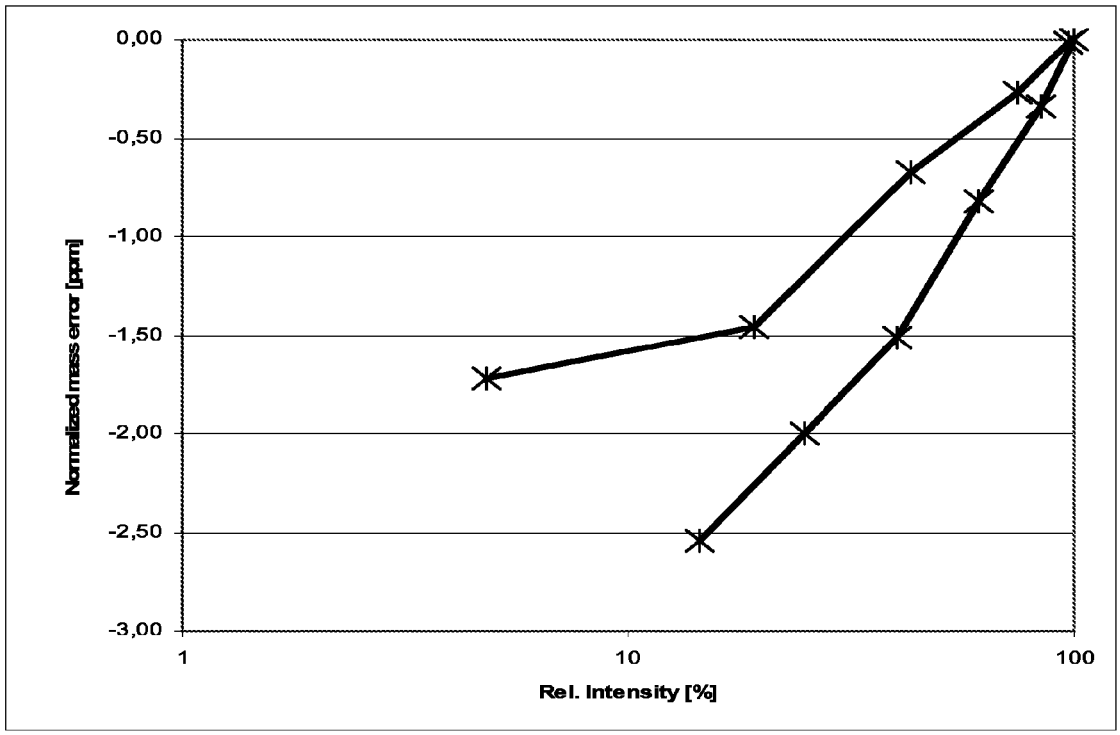
FIG. 6 shows the mass deviations for the isotopes of ubiquitin; the two curve branches seen here correspond to the increasing and decreasing isotopic abundances. The existence of these branches can be explained by signal shifts caused by the overlapping of the incompletely resolved ion signals, but the dependence on the signal intensity clearly predominates.

It should be noted here that in FIGS. 4 and 6 a normalization was applied so that the signals with the highest intensities have the mass deviation $\Delta(m/z)=0$. It must, however, be assumed that quite the opposite is true, namely that the smallest signals, which consist of ions flying alone, show no mass deviations. The larger the ion signal, the larger the deviation. This was taken into account in Equation [12] by not adding a constant term.

Time-of-flight mass spectra usually consist of hundreds or even thousands of individual spectra added together. The time-of-flight corrections as per Equations [10] and [12] can be applied either to the individual time-of-flight spectra before they are summed, or to the summed time-of-flight spectra. The correction of the mass as per Equation [11] can in principle also be applied before or after the summation, but in this case each individual spectrum must be subjected to a calibration function.

Figure 1:
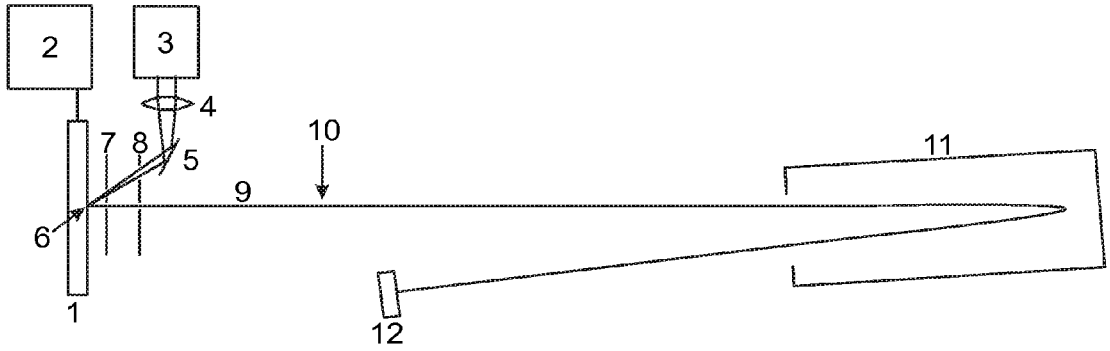
FIG. 1 (Prior Art)
FIG. 1 shows a schematic representation of a reflector time-of-flight mass spectrometer where samples on a sample plate (1) are ionized by a laser (3) by means of matrix-assisted laser desorption (MALDI). The ions are accelerated by voltages on the diaphragms (7) and (8) with respect to the voltage on the sample support plate (1), a voltage being switched on with a delay on diaphragm (7) and then taken to a limit value in a short, but finite time.

The operating principle of a MALDI mass spectrometer for the analysis of analyte substances whose masses are to be determined as accurately as possible is described briefly using the schematic representation in FIG. 1. The substances under analysis are prepared together with matrix material on a sample plate (1). Light pulses from the laser (3) are focused by a lens (4) and directed by a mirror (5) onto a sample (6) on the sample plate (1), causing analyte molecules of this sample (6) to be desorbed and ionized. Each light pulse produces a plasma cloud of vaporized matrix material which also contains analyte molecules. This plasma cloud, which initially has an extraordinarily high density, expands adiabatically into the surrounding vacuum and accelerates all the constituents by viscous entrainment to the same velocity distribution with an average velocity $v_0$, which is the same for particles of all masses. Some of the molecules are ionized during the expansion, and the ions receive the same velocity distribution.

By switching on voltages on the acceleration diaphragms (7) and (8), the ions are electrically accelerated further, and formed into an ion beam (9). The voltage on the acceleration diaphragm (7) is switched in such a way that the acceleration starts only with an adjustable time lag of between 50 and 500 nanoseconds approximately after the laser desorption has begun. This allows one species of analyte ions from the desorbed plasma cloud to be temporally focused in one location (10), as is elucidated in the above-mentioned document U.S. Pat. No. 5,654,545 A. This method is widely known under the name "delayed extraction" (DE) for MALDI time-of-flight mass spectrometers. Analyte ions of one species all fly through the point (10) at exactly the same time, but with different velocities. These ions can be precisely temporally focused onto the detector (12) by the velocity-focusing reflector (11) so that a high mass resolution is achieved for this species of analyte ion.

Figure 2:
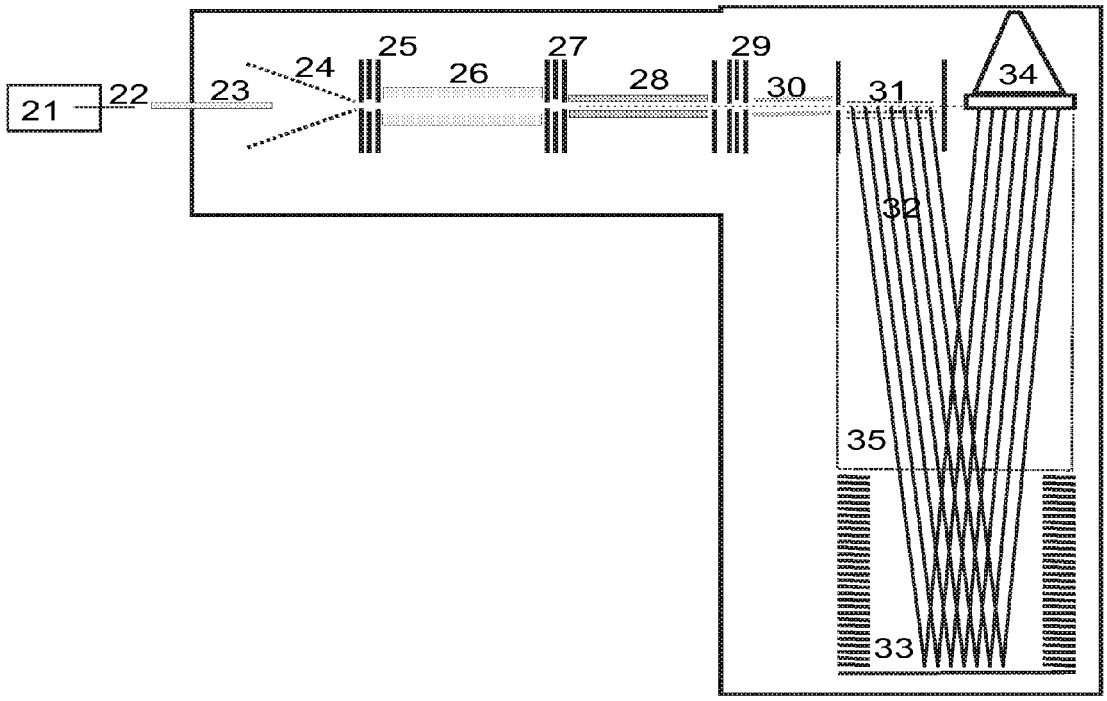
FIG. 2 (Prior Art)
FIG. 2 shows a schematic representation of a reflector time-of-flight mass spectrometer with orthogonal ion injection (OTOF). A segment of the primary ion beam is deflected in the pulser (31) by the sudden switching on of a voltage at right angles to the previous direction in order to shape the ion beam (32). This voltage also approaches a limit value in a finite time.

FIG. 2 is a schematic representation of a time-of-flight mass spectrometer with orthogonal ion injection. Ions are generated at atmospheric pressure in an ion source (21) with a spray capillary (22), and are introduced into the vacuum system through a capillary (23). An ion funnel (24) guides the ions through a lens system (25) into a first ion storage device (26), from which ions, switched by a further lens system (27), can be transferred into the storage device (28). The storage device (28) is charged with collision gas in order to focus the ions by means of collisions. From the ion storage device (28), the switching and acceleration lens (29) charges the pulser (31) with ions of a fine primary beam. The lens (29) can be used either continuously or as a switchable lens for the generation of individual ion packets. Between switching lens (29) and pulser (31), the flight region is shielded by a casing (30) in order to reduce the electrical influence that the switchable lens and the pulser exert on each other, and particularly also to reduce all electrical and magnetic interferences of the primary ion beam. The pulser ejects a section of the primary ion beam orthogonally into the drift region (35), which is at a high potential, thus creating the new ion beam (32). The ion beam (32) is reflected in the reflector (33) so as to be velocity-focused, and measured in the detector (34).

Investigations into the nature of the ion traffic jam have shown that it probably does not occur in the flight path of the mass spectrometer at all, but in the ion detectors (12) or (34). Several different detectors have resulted in qualitatively similar, but quantitatively different curves of the type shown in FIGS. 4 and 6.

The detectors (12) and (34) used in these time-of-flight mass spectrometers are always secondary-electron multipliers (SEM, often called "multipliers" for short). There are several types of multiplier: the oldest, which are still in use today, consist of discrete dynodes between which voltages in the order of 100 to 200 volts are applied by a voltage divider. There are such multipliers with 8 to 18 dynodes. The ions impinge on the first dynode, thus generating secondary electrons which are accelerated and then impinge onto the second dynode. Each of these electrons then generates several secondary electrons on average, so an avalanche of electrons forms along the dynodes. The amplification is the number of electrons from the last dynode per ion which impinge onto the first dynode. The amplifications of commercially available multipliers can be adjusted over a wide range, in the extreme case between $10^4$ and $10^8$, by changing the total voltage, although operating the multiplier at the highest voltages generally leads to very rapid aging.

The multipliers used for time-of-flight mass spectrometers have usually been multichannel plates. These generally consist of two plates, one behind the other, with channels at a slight angle to each other (chevron arrangement). In these multipliers, voltage drops exist across the surface of interior channels which, given an appropriate shape and surface conditioning, lead to electron avalanches in the channels. The amplification ranges are similar to those of dynode secondary-electron multipliers. The curves of the mass deviations as a function of the signal intensity shown in FIGS. 4 and 6 were measured with such multichannel plates.

Since exchanging the same or different types of multiplier changes the magnitude, and sometimes even the direction, of the erratic deviations, the traffic jam seems to arise in the multipliers. It is only possible to speculate about the mechanism by which the traffic jam occurs, but the probability is that it happens in the electron flow, not in the incident ion current. A traffic jam in the electron flow should then be independent of the mass or time of flight of the ions, however, and should depend only on the quantity of ions formed, i.e. on the measured signal intensity (signal height or signal area). It is thus probably appropriate to correct the time of flight solely by the signal intensity $s_i$, as shown in Equation [12]. Using Equation [12] to correct the time of flight (carried out simply with q=1) does indeed lead to a significant improvement in the mass accuracies.

While the invention has been shown and described with reference to a number of embodiments thereof, it will be recognized by those skilled in the art that various changes in form and detail may be made herein without departing from the spirit and scope of the invention as defined by the appended claims.

What is claimed is:

1. A method for accurately determining mass-to-charge ratios m/z of ions in a time-of-flight mass spectrometer that generates ion signals versus times of flight values comprising converting the times of flight values $(t_i-t_0)$ of the ion signals into mass-to-charge ratios $(m/z)_I$ with a conversion function that takes into account not only the times of flight values $(t_i-t_0)$ but also signal intensities $s_i$ of the ion signals.

2. The method of claim 1, wherein the conversion function comprises $(m/z)_i, =f((t_i-t_0)-g(t_i-t_0, s_i))$, where $f(t_i-t_0)$ represents a conventional calibration function, and $g(t_i-t_0, s_i)$ represents a correction of the time of flight $(t_i-t_0)$.

3. The method of claim 2, wherein the correction of the time of flight $g(t_i-t_0, s_i)$ comprises $g=p(\log s_i)^q$, where p and q are two fitting parameters.

4. The method of claim 3, wherein q=1.

5. The method of claim 2, wherein the correction of the time of flight is performed before a summation of the time-of-flight spectra.

6. The method of claim 2, wherein the correction of the time of flight is performed after a summation of the time-of-flight spectra.

7. The method of claim 1, wherein the conversion function also takes a number of charges of the ions $z_i$ into account.

8. The method of claim 7, wherein the conversion function comprises $(m/z)_i=f((t_i-t_0)-g(t_i-t_0, s_i, z_i))$, where $f(t_i-t_0)$ represents a calibration function, and $g(t_i-t_0, s_i, z_i)$ represents a correction of the time of flight $(t_i-t_0)$.

9. The method of claim 7, wherein the conversion function comprises $(m/z)_i'=f(t_i-t_0)-g'(t_i-t_0, s_i, z_i)$, where $f(t_i-t_0)$ represents a calibration function, and $g'(t_i-t_0, s_i, z_i)$ a correction of the mass-to-charge ratios $(m/z)_i$.

* * * * *